US006585269B1

(12) United States Patent
Lee

(10) Patent No.: US 6,585,269 B1
(45) Date of Patent: Jul. 1, 2003

(54) TABLE TYPE BASEBALL PLAYING TABLE STRUCTURE

(76) Inventor: Min-Kuo Lee, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/139,722

(22) Filed: May 3, 2002

(51) Int. Cl.[7] ..... A63F 7/06; A63F 7/20

(52) U.S. Cl. ..... 273/317.7; 273/317.9; 273/108.31; 273/108.32; 273/108.53; 273/129 S; 273/129 V

(58) Field of Search ..... 273/108.31, 108.32, 273/129 S, 129 T, 129 V, 129 W, 108.51, 108.53, 119 R, 121 D, 118 D, 126 R, 126 A, 108, 108.3, 108.33, 108.56, 317.7, 317.9, 317.6

(56) References Cited

U.S. PATENT DOCUMENTS 1,849,956 A * 3/1932 Robin
2,119,867 A * 6/1938 Mitchell
4,976,434 A * 12/1990 Wikner
5,046,734 A * 9/1991 Laine
5,443,262 A * 8/1995 Weng

* cited by examiner

*Primary Examiner*—Sebastiano Passaniti

(57) ABSTRACT

A table type baseball playing table structure includes a ball batting assembly, and a ball ejection assembly. Thus, the pitcher may pull and release the ball ejection handle, so that the ball striking rod may be pushed by the spring to strike the ball by the eccentric post. After the ball is ejected outward by the eccentric post of the ball striking rod into the top face of the table, the batter may push the handle to move the pull rod, so that the shaft may be rotated by engagement between the gear face of the shaft and the serrated face of the pull rod. Thus, rotation of the shaft may drive the bat to rotate, so as to bat the ball ejected from the ball ejection assembly.

11 Claims, 8 Drawing Sheets

34
341
4
333
33
35
340
1
32
314
36
31

34
4
333
33
31

4
333
33
314

TABLE TYPE BASEBALL PLAYING TABLE STRUCTURE

BACKGROUND OF THE INVENTION

1. Field of the Invention

The present invention relates to a table type baseball playing table structure, and more particularly to a table type baseball playing table structure including a ball batting assembly that may bat the ball, and a ball ejection assembly that may eject the ball, so that one of two players may serve as the batter and the other may serve as the pitcher, thereby achieving the amusement effect of playing the baseball.

2. Description of the Related Art

The baseball game usually needs many people to participate, and a large field to play. Thus, it is necessary to find a large field to play the baseball. In addition, the baseball game cannot play due to fewer players.

SUMMARY OF THE INVENTION

The primary objective of the present invention is to provide a table type baseball playing table structure including a ball batting assembly that may bat the ball, and a ball ejection assembly that may eject the ball, so that one of two players may serve as the batter and the other may serve as the pitcher, thereby achieving the amusement effect of playing the baseball.

In accordance with the present invention, there is provided a table type baseball playing table structure, comprising a table, a ball batting assembly, and a ball ejection assembly, wherein:

the ball batting assembly includes a handle, a pull rod, a fixing seat, a shaft, and a bat;

the handle has a front end provided with a protruding post, and multiple positioning heads enclosed around the protruding post;

the pull rod has a rear end formed with a receiving recess for insertion and combination of the protruding post of the handle, and multiple positioning recesses enclosed around the receiving recess for insertion and combination of the positioning heads of the handle, the pull rod has a periphery provided with two radially opposite protruding bars, and has a mediate section provided with a serrated face;

the fixing seat has two side walls each formed with a through hole for passage of the pull rod, the through hole of each of the two side walls of the fixing seat is formed with two radially opposite locking cavities for passage of the two radially opposite protruding bars of the pull rod;

the shaft has a lower end provided with an annular gear face meshing with the serrated face of the pull rod, and an upper end provided with a polygonal post; and the bat has a distal end formed with a polygonal receiving recess for securing the polygonal post of the shaft;

the ball ejection assembly includes a ball ejection handle, a face plate fixing seat, a ball striking rod, a ball ejection tube, and a spring;

the ball ejection handle is formed with a channel for receiving the ball striking rod;

the face plate fixing seat is secured on an outer side face of the table, and is formed with a passage tube for passage of the ball striking rod;

the ball striking rod has a rear end secured in the channel of the ball ejection handle, and a front end provided with a protruding eccentric post;

the ball ejection tube is mounted in the table and has a first end in which the ball striking rod is movably mounted and a second end connected to a top face of the table; and the spring is mounted on the ball striking rod, and is biased between the face plate fixing seat and the ball striking rod.

Further benefits and advantages of the present invention will become apparent after a careful reading of the detailed description with appropriate reference to the accompanying drawings.

DETAILED DESCRIPTION OF THE INVENTION

Figure 1:
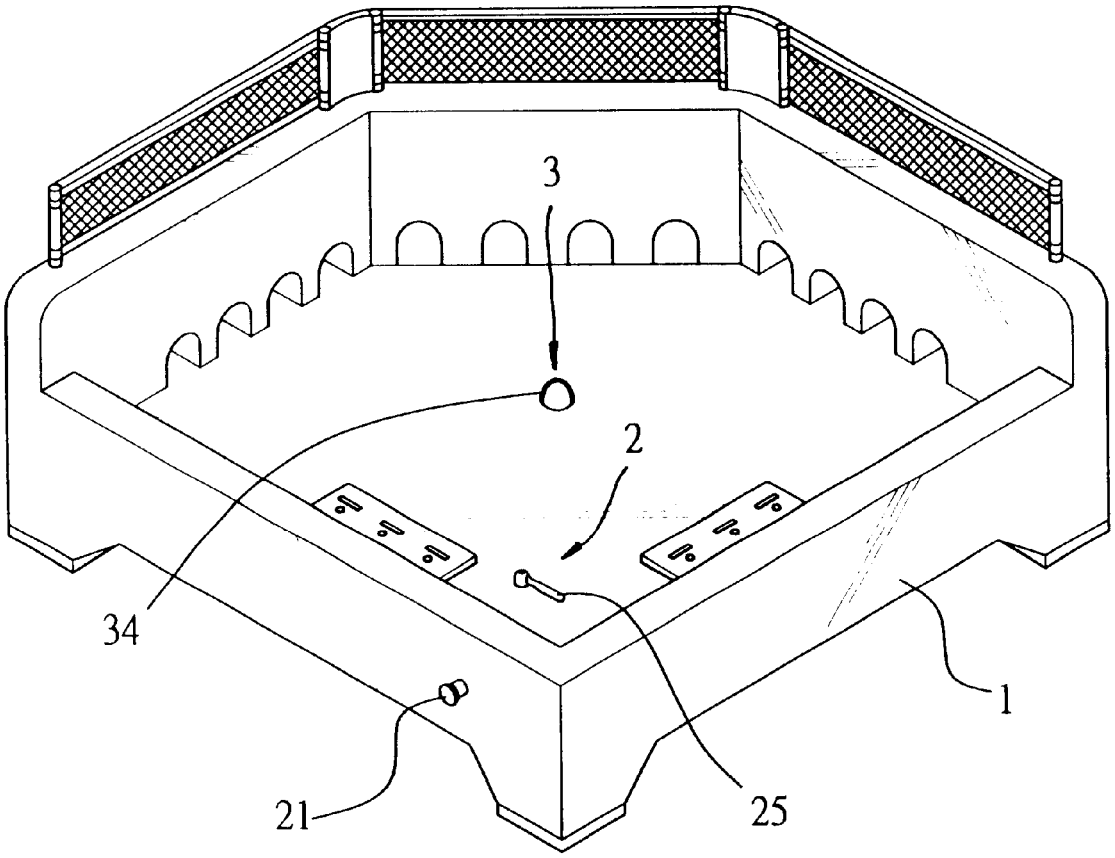
FIG. 1 is a front perspective view of a table type baseball playing table structure in accordance with a first embodiment of the present invention.
Figure 1A:
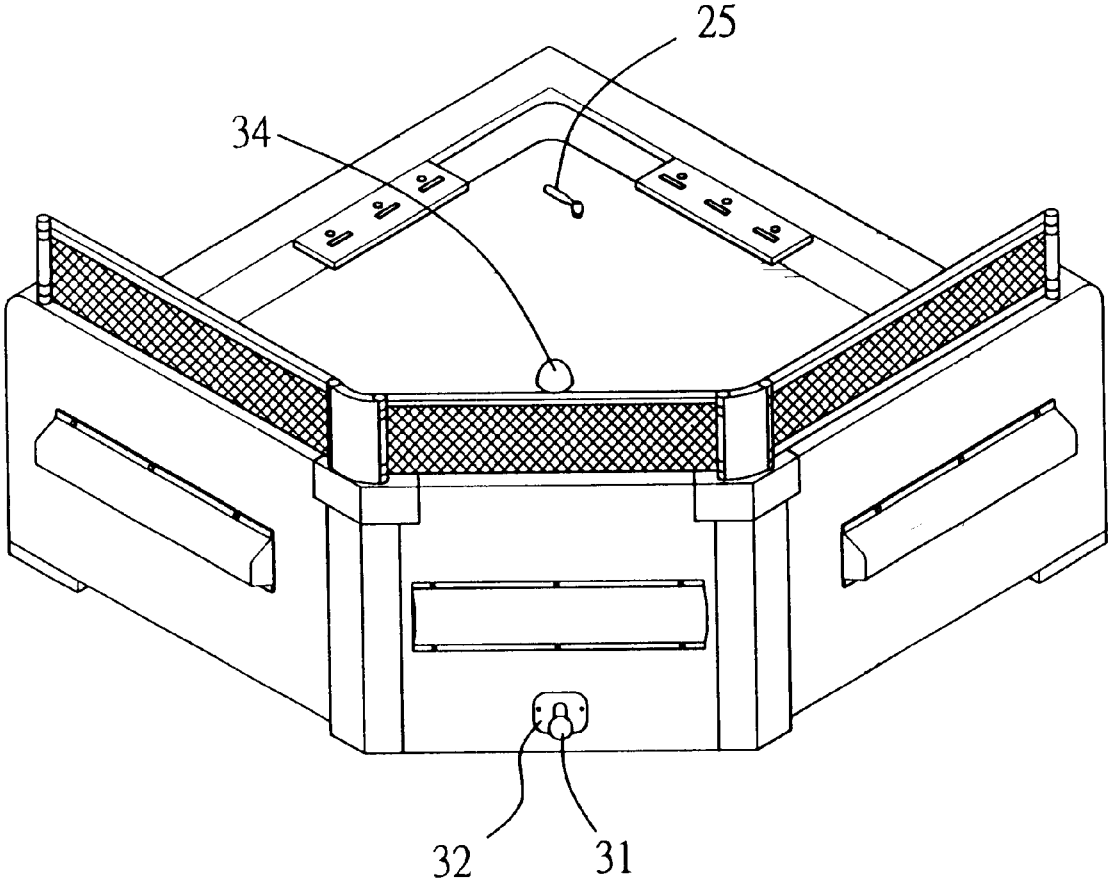
FIG. 1A is a rear perspective view of a table type baseball playing table structure in accordance with the first embodiment of the present invention.
Figures 2, 2A:
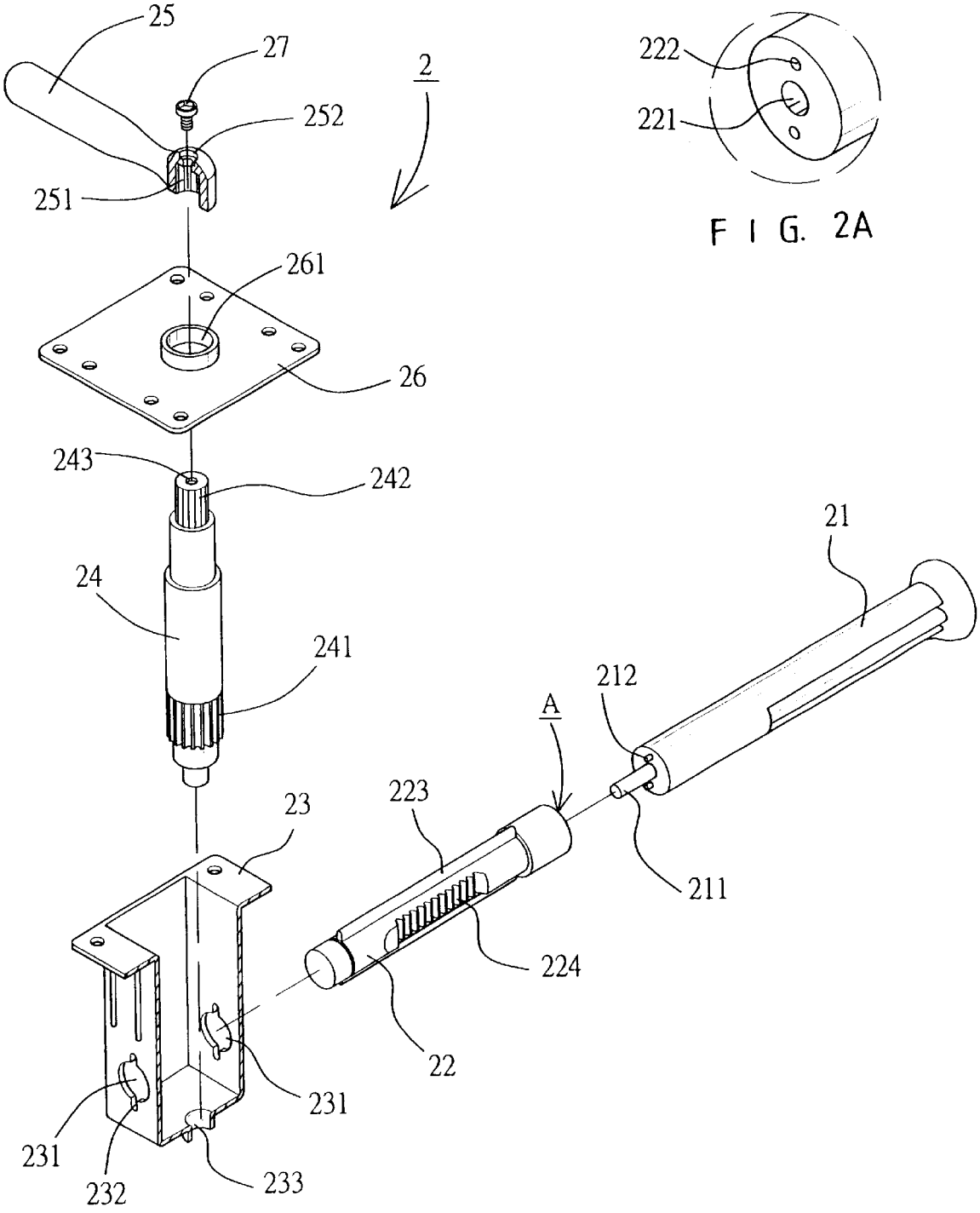
FIG. 2 is an exploded perspective view of a ball batting assembly of the table type baseball playing table structure in accordance with the first embodiment of the present invention.
FIG. 2A is a partially cut-away view of a pull rod of the ball batting assembly of the table type baseball playing table structure as shown in FIG. 2.
Figures 3, 3A:
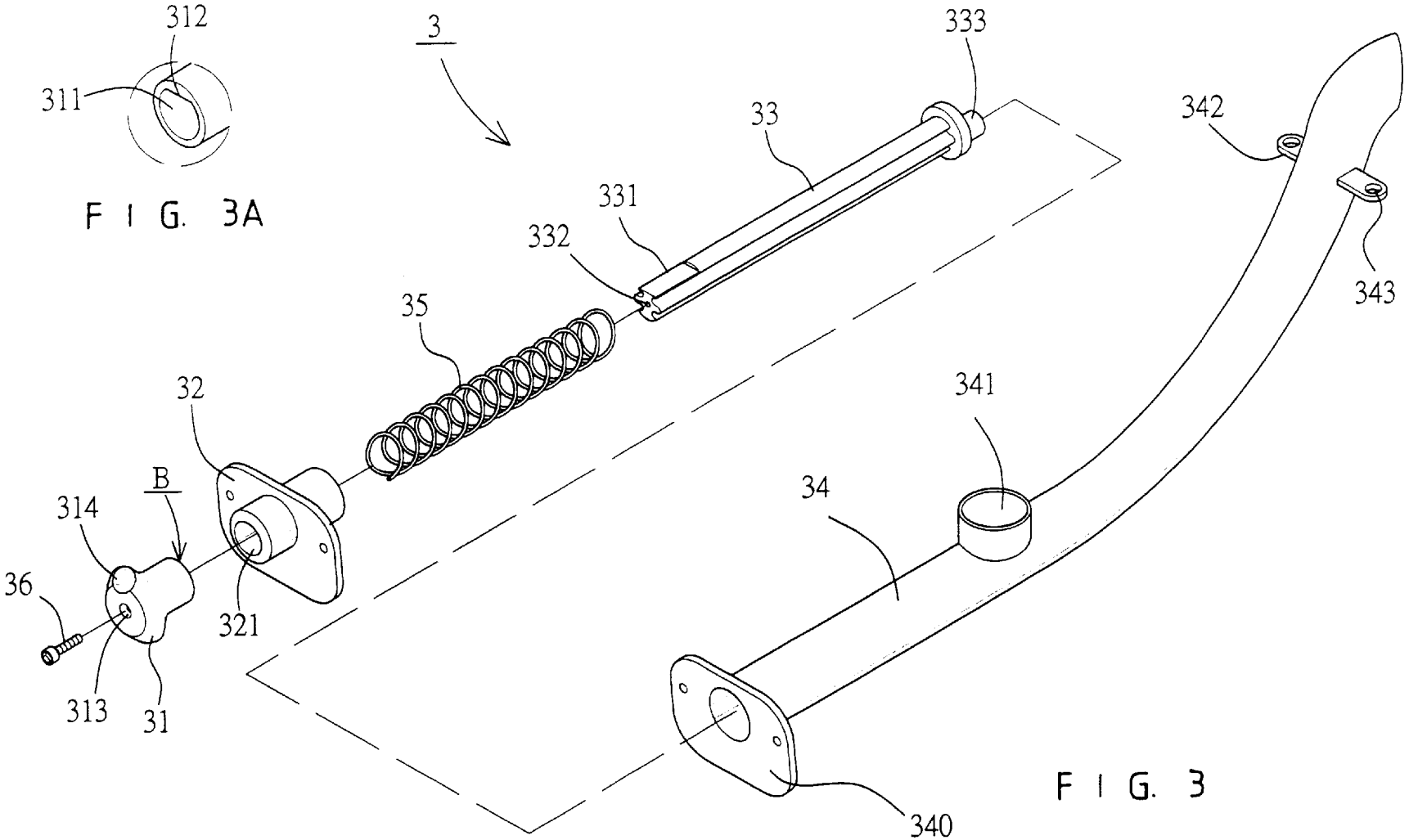
FIG. 3 is an exploded perspective view of a ball ejection assembly of the table type baseball playing table structure in accordance with the first embodiment of the present invention.
FIG. 3A is a partially cut-away view of a ball ejection handle of the ball ejection assembly of the table type baseball playing table structure as shown in FIG. 2.
Figure 4:
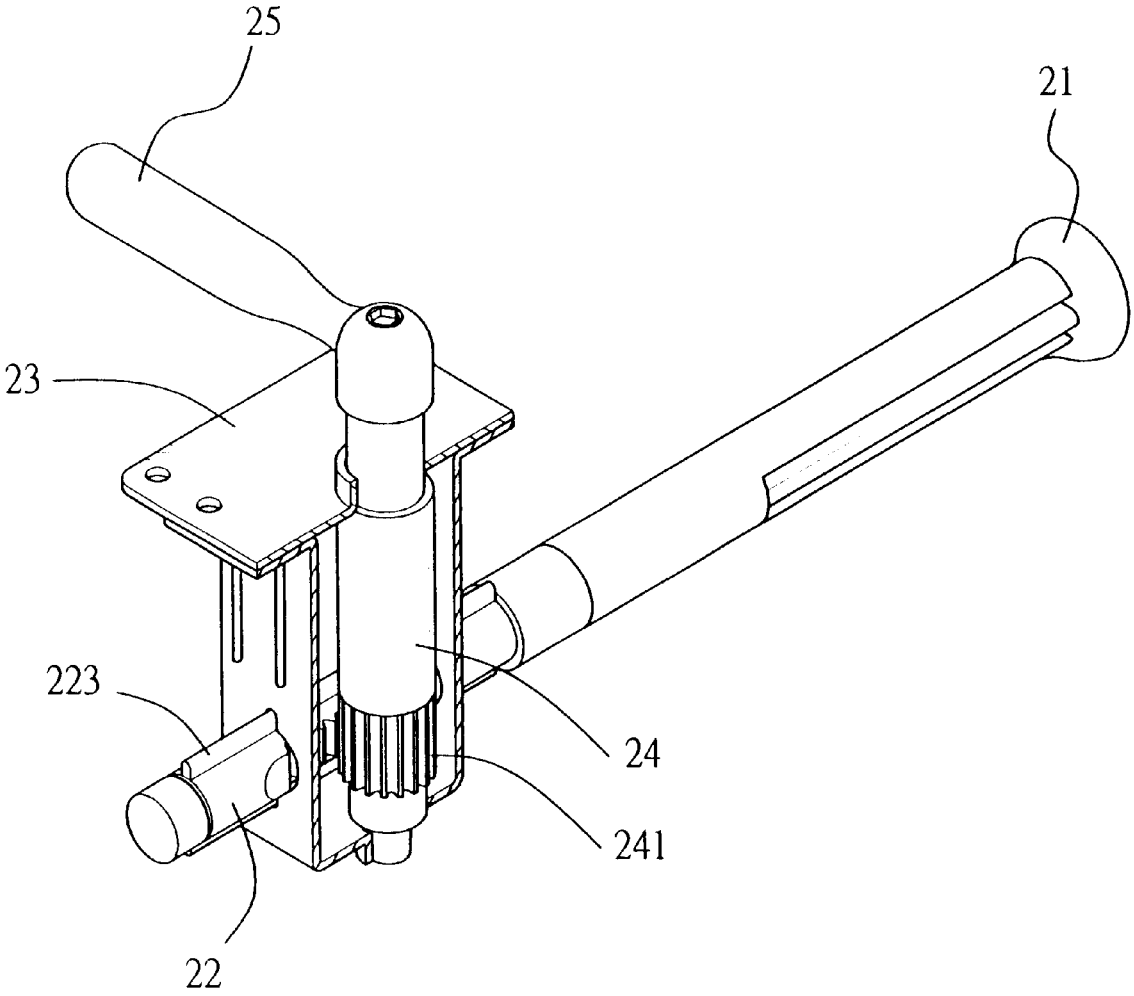
FIG. 4 is a partially cut-away perspective assembly view of the ball batting assembly of the table type baseball playing table structure as shown in FIG. 2.

Referring to the drawings and initially to FIGS. 1–5, a table type baseball playing table structure in accordance with a first embodiment of the present invention comprises a table 1 having a front end provided with a ball batting assembly 2 that may bat the ball 4 (see FIG. 5), and a rear end provided with a ball ejection assembly 3 that may eject the ball 4, thereby constructing the table type baseball playing table structure of the present invention, so that one of two players may serve as the batter and the other may serve as the pitcher.

The ball batting assembly 2 includes a handle 21, a pull rod 22, a fixing seat 23, a shaft 24, and a bat 25.

The handle 21 has a front end provided with a protruding post 211, and multiple positioning heads 212 enclosed around the protruding post 211.

The pull rod 22 has a rear end formed with a receiving recess 221 for insertion and combination of the protruding post 211 of the handle 21, and multiple positioning recesses 222 enclosed around the receiving recess 221 for insertion and combination of the positioning heads 212 of the handle 21. The pull rod 22 has a periphery provided with two radially opposite protruding bars 223, and has a mediate section provided with a serrated face 224.

The fixing seat 23 has two side walls each formed with a through hole 231 for passage of the pull rod 22. The through hole 231 of each of the two side walls of the fixing seat 23 is formed with two radially opposite locking cavities 232 for passage of the two radially opposite protruding bars 223 of the pull rod 22. The fixing seat 23 has a bottom wall formed with a positioning hole 233.

The shaft 24 has a lower end provided with an annular gear face 241, and an upper end provided with a polygonal post 242 which is formed with a screwed bore 243.

The bat 25 has a distal end formed with a polygonal receiving recess 251 which has a top formed with a depression 252.

In assembly, the protruding post 211 of the handle 21 is inserted into the receiving recess 221 of the pull rod 22, and the positioning heads 212 of the handle 21 is inserted into the multiple positioning recesses 222 of the pull rod 22, so that the handle 21 may be combined with of the pull rod 22 integrally, wherein the handle 21 is exposed outward from the outer side of the table 1 as shown in FIG. 1. The pull rod 22 passes through the through hole 231 of the fixing seat 23, and the two radially opposite protruding bars 223 of the pull rod 22 are inserted into and locked in the two radially opposite locking cavities 232 of the fixing seat 23, so that the pull rod 22 may be movably secured in the fixing seat 23. The lower end of the shaft 24 is inserted into the positioning hole 233 of the fixing seat 23, and the gear face 241 of the shaft 24 meshes with the serrated face 224 of the pull rod 22. A cover plate 26 is secured on the top of the fixing seat 23, so that the cover plate 26 and the fixing seat 23 are combined integrally, and are secured under the table 1. The cover plate 26 is formed with an opening 261 for passage of the polygonal post 242 of the shaft 24, so that the polygonal post 242 of the shaft 24 protrudes outward from the top of the table 1 for mounting the receiving recess 251 of the bat 25. A screw 27 is extended through the depression 252 of the bat 25, and is screwed into the screw bore 243 of the polygonal post 242 of the shaft 24, so that the bat 25 is secured on the polygonal post 242 of the shaft 24, and may be rotated with the shaft 24.

In operation, when the handle 21 is pushed or pulled, the pull rod 22 may be moved by the handle 21, so that the shaft 24 may be rotated by engagement between the gear face 241 of the shaft 24 and the serrated face 224 of the pull rod 22. Rotation of the shaft 24 may drive the bat 25 to rotate, so as to simulate the batting operation.

The ball ejection assembly 3 includes a ball ejection handle 31, a face plate fixing seat 32, a ball striking rod 33, a ball ejection tube 34, and a spring 35.

The ball ejection handle 31 is formed with a channel 311 which is provided with a flattened face 312. The ball ejection handle 31 has an end face having a center formed with a through hole 313 and having a periphery formed with a finger press dimple 314.

The face plate fixing seat 32 is secured on the outer side face of the table 1, and is formed with a passage tube 321.

The ball striking rod 33 has a rear end having a center formed with a screw bore 332, and a front end provided with a protruding eccentric post 333. The rear end of the ball striking rod 33 has a periphery provided with a flat face 331.

The ball ejection tube 34 has a bent front section and a straight rear section. The ball ejection tube 34 has periphery provided with a ball collection tube 341 which communicates with the inside of the ball ejection tube 34. The ball ejection tube 34 has a rear end provided with a fixing plate 340, and a front end provided with two radially opposite fixing ears 342 each formed with a screw bore 343.

The spring 35 is mounted on the ball striking rod 33.

Figures 5, 5A, 5B:
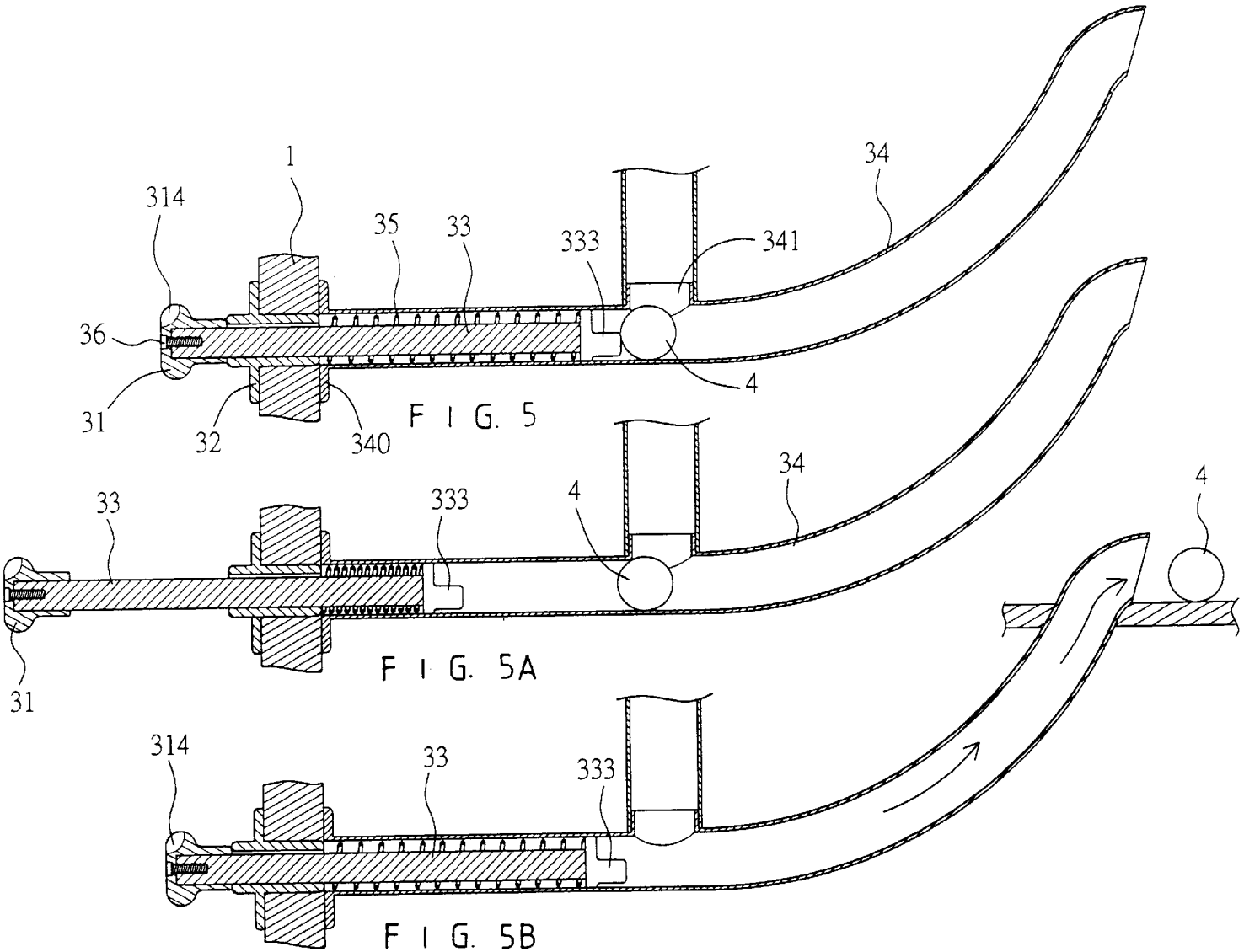
FIG. 5 is a side plan cross-sectional assembly view of the ball ejection assembly of the table type baseball playing table structure as shown in FIG. 3.
FIG. 5A is a schematic operational view of the ball ejection assembly of the table type baseball playing table structure as shown in FIG. 5.
FIG. 5B is a schematic operational view of the ball ejection assembly of the table type baseball playing table structure as shown in FIG. 5A.

In assembly, the face plate fixing seat 32 is secured on the outer side face of the table 1. The fixing plate 340 of the rear end of the ball ejection tube 34 is screwed on the inner side face of the table 1, and the two radially opposite fixing ears 342 of the front end of the ball ejection tube 34 is screwed on the bottom face of the table 1, with the opening of the front end of the ball ejection tube 34 protruding outward from the top face of the table 1 as shown in FIG. 5B. The ball striking rod 33 is movably mounted in the straight rear section of the ball ejection tube 34, and is extended through the spring 35. The rear end of the ball striking rod 33 is passed through the passage tube 321 of the face plate fixing seat 32. The ball ejection handle 31 is mounted on the rear end of the ball striking rod 33, and is protruded outward from the outer side face of the table 1. In such a manner, the rear end of the ball striking rod 33 is inserted into the channel 311 of the ball ejection handle 31, and the flat face 331 of the ball striking rod 33 is rested on the flattened face 312 of the ball ejection handle 31. Thus, the ball striking rod 33 may be rotated by the ball ejection handle 31. In addition, a screw 36 is extended through the through hole 313 of the ball ejection handle 31, and is screwed into the screw bore 332 of the rear end of the ball striking rod 33, thereby securing the ball ejection handle 31 on the rear end of the ball striking rod 33, so that the ball striking rod 33 may be moved with the ball ejection handle 31.

In operation, as shown in FIG. 5, the ball 4 may fall into the ball ejection tube 34 from the ball collection tube 341, and is rested on the eccentric post 333 of the ball striking rod 33. Then, the pitcher may pull the ball ejection handle 31, so that the ball striking rod 33 is pulled outward by the ball ejection handle 31 to move from the position as shown in FIG. 5 to the position as shown in FIG. 5A, thereby compressing the spring 35. Then, the ball ejection handle 31 may be released, so that the ball striking rod 33 may be pushed by the restoring force of the spring 35 to move from the position as shown in FIG. 5A to the position as shown in FIG. 5B, so as to strike the ball 4 by the eccentric post 333, so that the ball 4 may be pushed outward from the ball ejection tube 34 and may be moved into the top face of the table 1, thereby accomplishing the ball ejection process.

Figure 6:
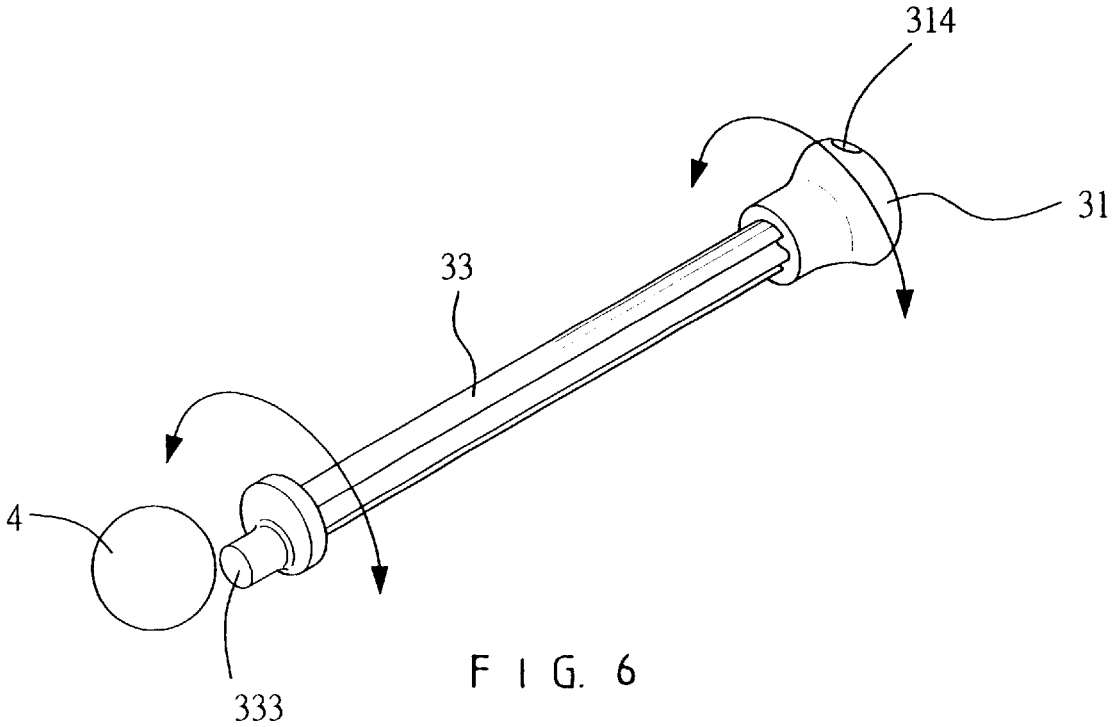
FIG. 6 is a schematic operational view of the ball ejection assembly of the table type baseball playing table structure as shown in FIG. 3.
Figure 6A:
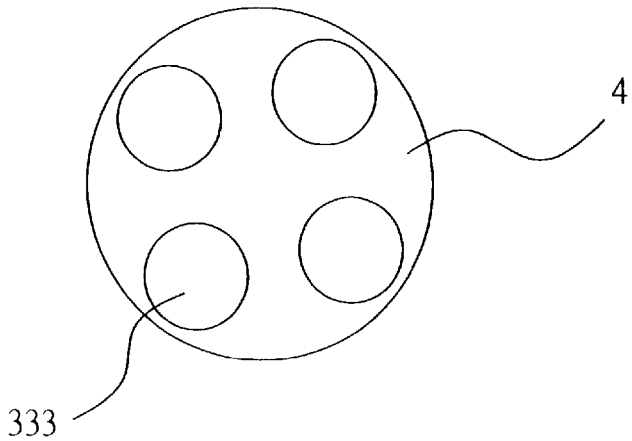
FIG. 6A is a side plan view of the ball ejection assembly of the table type baseball playing table structure as shown in FIG. 6.

Referring to FIG. 6, the users' one finger may press the finger press dimple 314 to rotate the ball ejection handle 31, so that the ball striking rod 33 may be rotated by the ball ejection handle 31. Thus, by rotation of the ball striking rod 33, the eccentric post 333 may be moved to different eccentric positions relative to the ball 4 as shown in FIG. 6, so that the ball 4 may be stricken by the eccentric post 333 to move along different directions, thereby varying the directions of travel of the rotating ball 4. Thus, the ball 4 ejected from the ball ejection assembly 3 may be moved along various different directions, thereby enhancing the variation and amusement effect of the table type baseball playing table structure in accordance with the first embodiment of the present invention.

After the ball 4 is ejected outward by the eccentric post 333 of the ball striking rod 33 into the top face of the table 1, the batter may push the handle 21 to move the pull rod 22, so that the shaft 24 may be rotated by engagement between the gear face 241 of the shaft 24 and the serrated face 224 of the pull rod 22. Thus, rotation of the shaft 24 may drive the bat 25 to rotate, so as to bat the ball 4 ejected from the ball ejection assembly 3.

Figure 7:
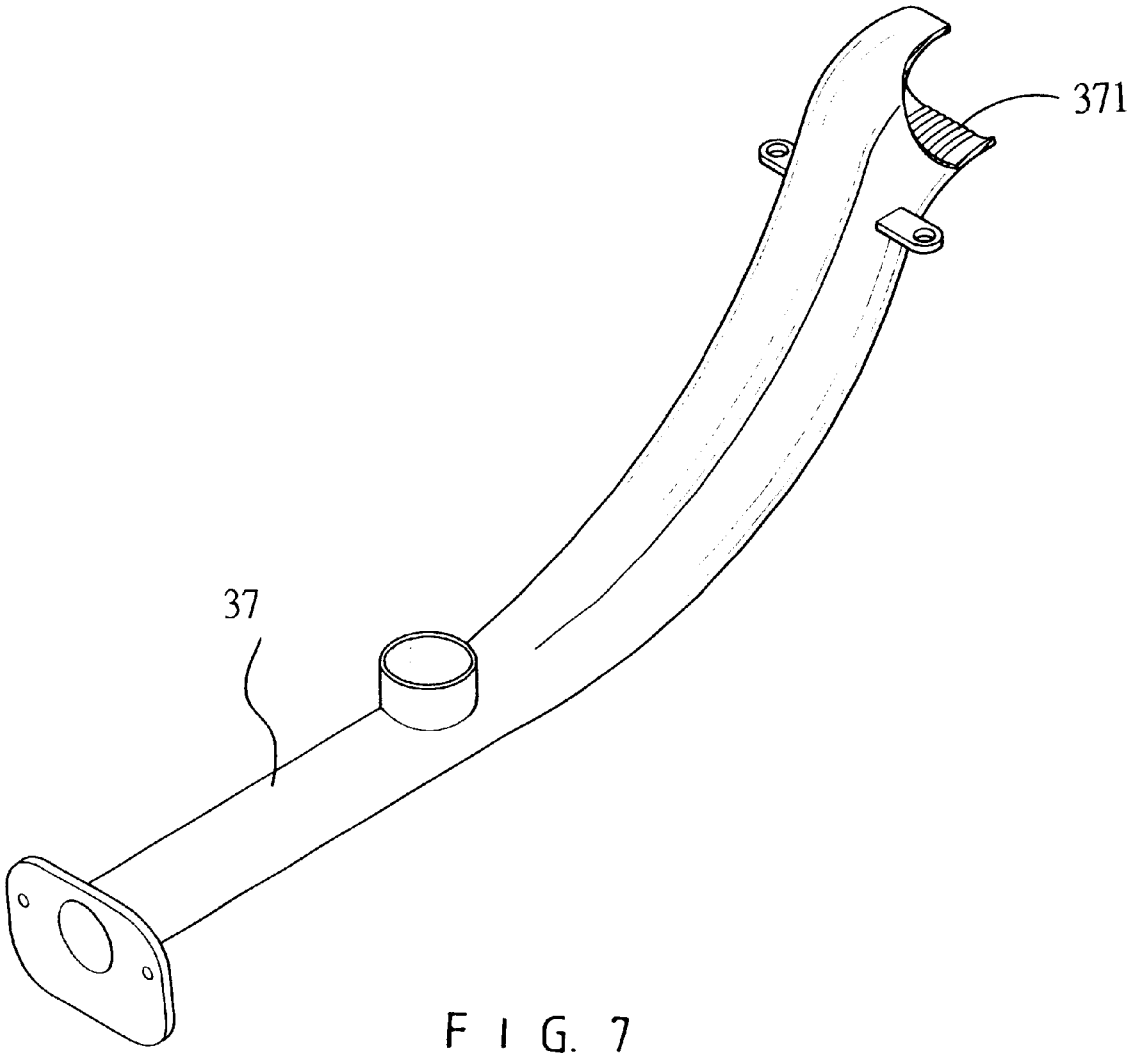
FIG. 7 is a partially cut-away perspective view of a ball ejection tube of a table type baseball playing table structure in accordance with a second embodiment of the present invention.
Figure 7A:
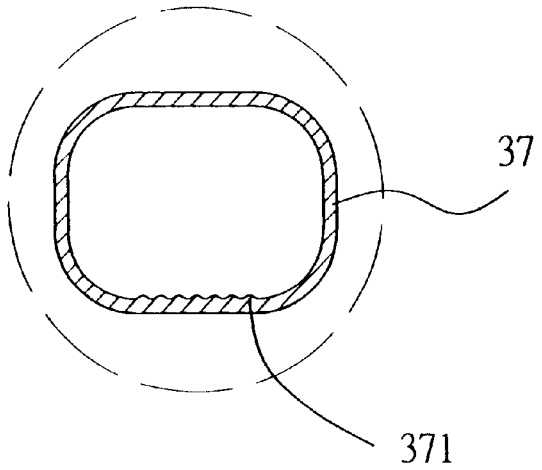
FIG. 7A is a side plan cross-sectional view of the ball ejection tube of the table type baseball playing table structure as shown in FIG. 7.

Referring to FIGS. 7 and 7A, a table type baseball playing table structure in accordance with a second embodiment of the present invention is shown.

The front end of the ball ejection tube 37 has an oblong diffusion opening, so that when the ball 4 is ejected outward from the front end of the ball ejection tube 37, the travel path of the ball 4 may be changed, thereby enhancing the variation of direction of the ball 4. In addition, the oblong diffusion opening of the front end of the ball ejection tube 37 is provided with a corrugated face 371, so that ball 4 may jump and hop during travel, thereby enhancing the variation of direction of the ball 4.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A table type baseball playing table structure, comprising a table, a ball batting assembly, and a ball ejection assembly, wherein:

the ball batting assembly includes a handle, a pull rod, a fixing seat, a shaft, and a bat;

the handle has a front end provided with a protruding post, and multiple positioning heads enclosed around the protruding post;

the pull rod has a rear end formed with a receiving recess for insertion and combination of the protruding post of the handle, and multiple positioning recesses enclosed around the receiving recess for insertion and combination of the positioning heads of the handle, the pull rod has a periphery provided with two radially opposite protruding bars, and has a mediate section provided with a serrated face;

the fixing seat has two side walls each formed with a through hole for passage of the pull rod, the through hole of each of the two side walls of the fixing seat is formed with two radially opposite locking cavities for passage of the two radially opposite protruding bars of the pull rod;

the shaft has a lower end provided with an annular gear face meshing with the serrated face of the pull rod, and an upper end provided with a polygonal post; and the bat has a distal end formed with a polygonal receiving recess for securing the polygonal post of the shaft;

the ball ejection assembly includes a ball ejection handle, a face plate fixing seat, a ball striking rod, a ball ejection tube, and a spring;

the ball ejection handle is formed with a channel for receiving the ball striking rod;

the face plate fixing seat is secured on an outer side face of the table, and is formed with a passage tube for passage of the ball striking rod;

the ball striking rod has a rear end secured in the channel of the ball ejection handle, and a front end provided with a protruding eccentric post;

the ball ejection tube is mounted in the table and has a first end in which the ball striking rod is movably mounted and a second end connected to a top face of the table; and the spring is mounted on the ball striking rod, and is biased between the face plate fixing seat and the ball striking rod.

2. The table type baseball playing table structure in accordance with claim 1, wherein the fixing seat has a bottom wall formed with a positioning hole for positioning the lower end of the shaft.

3. The table type baseball playing table structure in accordance with claim 1, wherein the polygonal post of the shaft is formed with a screwed bore, the polygonal receiving recess of the bat has a top formed with a depression, and the ball batting assembly further includes a screw extended through the depression of the bat, and screwed into the screw bore of the polygonal post of the shaft.

4. The table type baseball playing table structure in accordance with claim 1, wherein the ball ejection handle has an end face having a center formed with a through hole and having a periphery formed with a finger press dimple, the rear end of the ball striking rod has a center formed with a screw bore, and the ball ejection assembly further includes a screw extended through the through hole of the ball ejection handle, and screwed into the screw bore of the rear end of the ball striking rod.

5. The table type baseball playing table structure in accordance with claim 1, wherein the channel of the ball ejection handle is formed with a flattened face, and the rear end of the ball striking rod has a periphery provided with a flat face rested on the flattened face of the ball ejection handle.

6. The table type baseball playing table structure in accordance with claim 1, wherein the ball ejection tube has a bent front section and a straight rear section.

7. The table-type baseball playing table structure in accordance with claim 1, wherein the ball ejection tube has a periphery provided with a ball collection tube which communicates with an inside of the ball ejection tube.

8. The table type baseball playing table structure in accordance with claim 1, wherein the first end of the ball ejection tube is provided with a fixing plate.

9. The table type baseball playing table structure in accordance with claim 1, wherein the second end of the ball ejection tube is provided with two radially opposite fixing ears each formed with a screw bore.

10. The table type baseball playing table structure in accordance with claim 1, wherein the second end of the ball ejection tube has an oblong diffusion opening.

11. The table type baseball playing table structure in accordance with claim 10, wherein the oblong diffusion opening of the second end of the ball ejection tube is provided with a corrugated face.

* * * * *